US005101821A

United States Patent [19]

Carie, Jr.

[11] Patent Number: 5,101,821

[45] Date of Patent: Apr. 7, 1992

[54] CONDENSATE DRAIN FOR RESPIRATORY AIR LINE

[76] Inventor: John Carie, Jr., R.R. 4, Box 496, Olney, Ill. 62450

[21] Appl. No.: 695,103

[22] Filed: May 3, 1991

[51] Int. Cl.[5] ..... A62B 7/10

[52] U.S. Cl. ..... 128/205.12; 128/205.24; 128/912

[58] Field of Search ..... 128/204.18, 205.12, 128/205.24, 912; 137/192; 210/123, 124

[56] References Cited

U.S. PATENT DOCUMENTS

| | | | |
|---|---|---|---|
| 565,970 | 8/1896 | Farrell | 137/192 |
| 771,398 | 10/1904 | Schwaninger | 137/192 |
| 1,102,768 | 7/1914 | Leuthesser | 137/192 |
| 1,998,695 | 4/1935 | White | 137/192 |
| 2,817,689 | 12/1957 | White | 137/192 |
| 2,989,052 | 6/1961 | Broman | 137/192 |
| 3,227,173 | 1/1966 | Bernstein | 137/192 |
| 3,454,005 | 7/1969 | Eubanks et al. | 128/186 |
| 3,682,166 | 8/1972 | Jacobs | 128/145.8 |
| 3,968,812 | 7/1976 | Eross | 137/188 |
| 4,020,834 | 5/1977 | Bird | 128/145.6 |
| 4,090,513 | 5/1978 | Togawa | 128/212 |
| 4,327,718 | 5/1982 | Cronenberg | 128/205.12 |
| 4,457,305 | 7/1984 | Shanks et al. | 128/205.12 |
| 4,510,933 | 4/1985 | Wendt et al. | 128/207.14 |
| 4,622,964 | 11/1986 | Flynn | 128/205.24 |
| 4,717,403 | 1/1988 | Chokal | 55/429 |
| 4,867,153 | 9/1989 | Lorenzen et al. | 128/205.12 |
| 4,870,987 | 10/1989 | Cheng | 137/192 |
| 4,951,661 | 8/1990 | Sladek | 128/205.24 |

*Primary Examiner*—Edgar S. Burr
*Assistant Examiner*—Aaron J. Lewis
*Attorney, Agent, or Firm*—Armstrong, Teasdale, Schlafly & Davis

[57] ABSTRACT

A drain for removing condensate from a respiratory air line comprising a hollow body having an inlet end, adapted for connection to the respiratory air line, and an outlet end. A normally closed float valve restricts the flow of air through the body during periods of relatively high pressure in the respiratory line, but opens in the presence of condensate to allow condensate to flow out of the body. A reed-type valve permits condensate to pass through the body from the inlet to the outlet, but restricts condensate from refluxing back into the respiratory line during periods of relatively low pressure in the respiratory line. The reed-type valve is of the type comprising two converging flexible members configured to allow condensate to flow in one direction through the body.

18 Claims, 4 Drawing Sheets

FIG. 4.
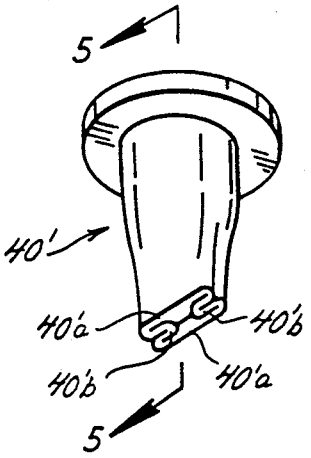
FIG. 5.
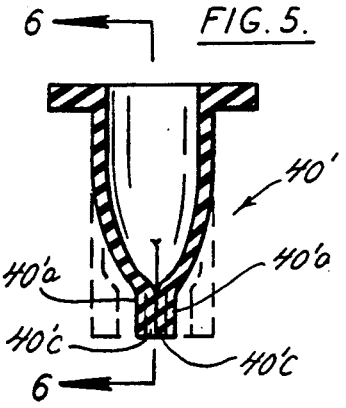
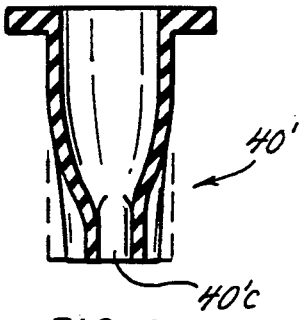
FIG. 6.
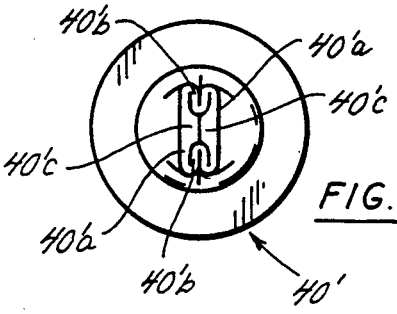
FIG. 7.
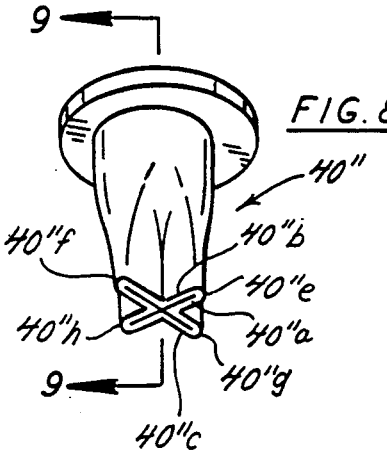
FIG. 8.
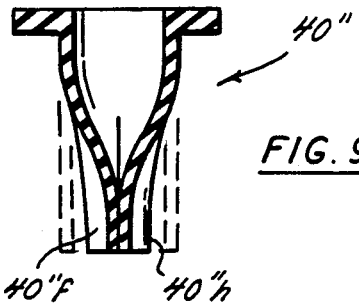
FIG. 9.
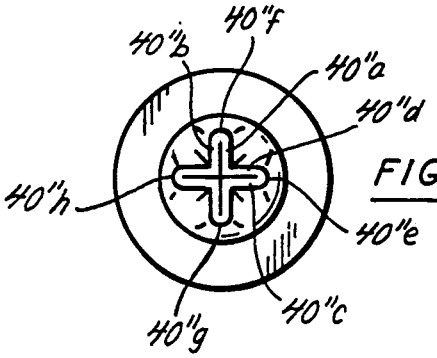
FIG. 10.

FIG. 11.
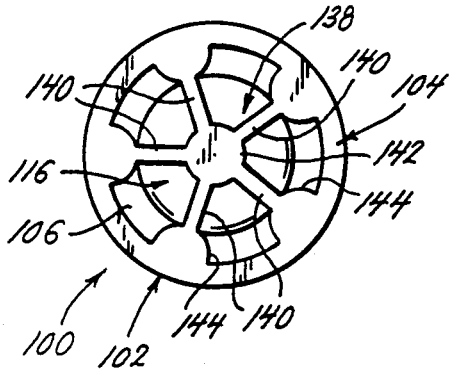
FIG. 13.
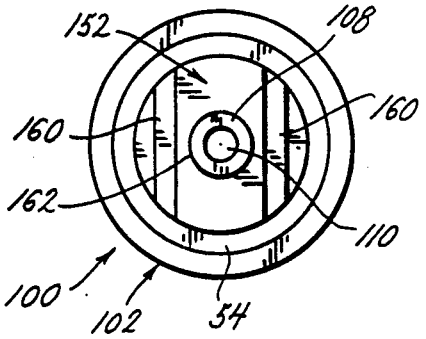
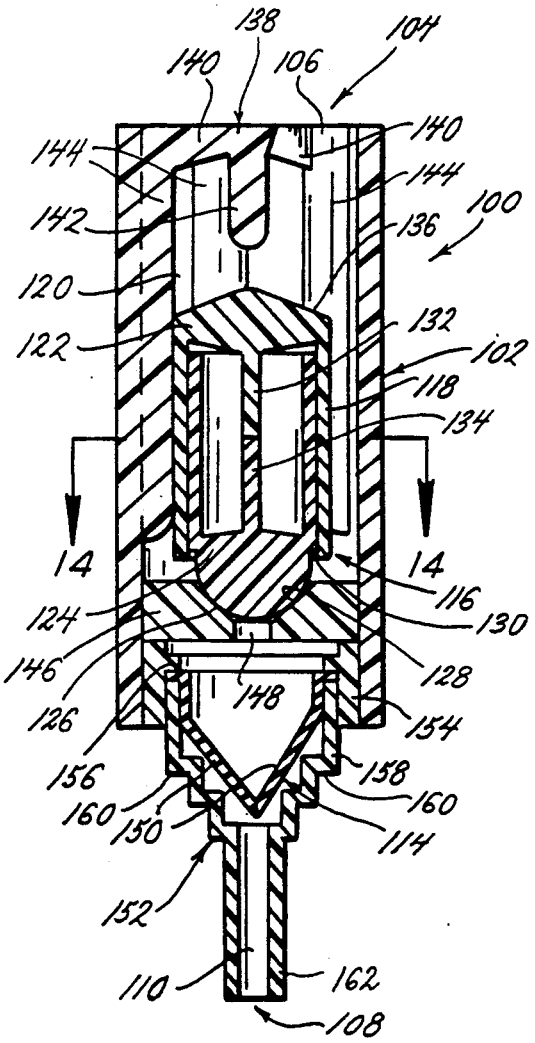
FIG. 12.
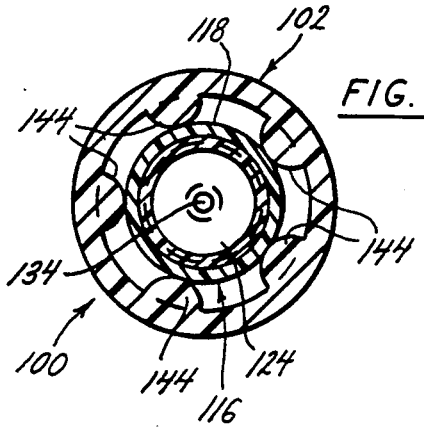
FIG. 14.
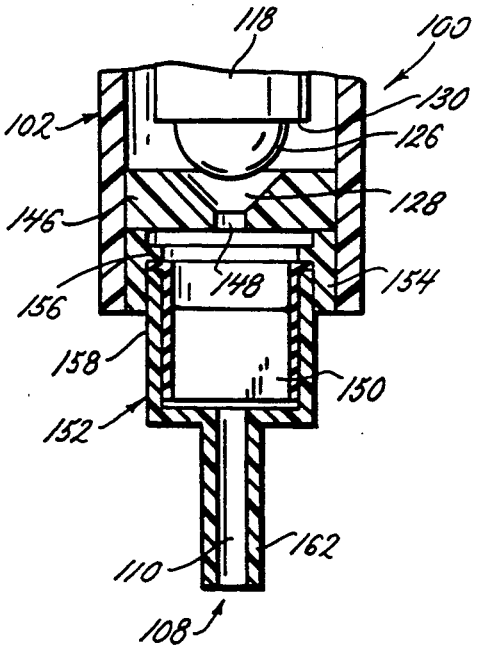
FIG. 15.

CONDENSATE DRAIN FOR RESPIRATORY AIR LINE

BACKGROUND OF THE INVENTION

This invention relates to a condensate drain for a respiratory air line, and particularly to a drain for an air line of the type that is alternately under high pressure during the patient's inspiration and low pressure during the patient's expiration.

It is common practice to humidify air provided to a patient on a respirator in order to prevent the lungs and other delicate tissues from drying out. However, a significant fraction of the water added to the respiratory air condenses in the respiratory air line. The condensate accumulates in the low point of the respiratory air line, and so much water can accumulate that it actually interferes with the passage of respiratory air to the patient. Various attempts have been made to provide devices that can drain the condensate without interfering with the function of the respiratory line of carrying respiratory air to the patient. Examples of such devices are shown in Eubanks et al., U.S. Pat. No. 3,545,005; Jacobs, U.S. Pat. No. 3,682,166; Togawa, U.S. Pat. No. 4,090,513; Bird, U.S. Pat. No. 4,020,834; Cronenberg, U.S. Pat. No. 4,327,718; Shanks et al., U.S. Pat. No. 4,457,305; and Chokel, U.S. Pat. No. 4,717,403, incorporated herein by reference.

Generally, the previously available devices have suffered from a number of disadvantages. Many of these devices did not properly seal so that respiratory gas would escape with the condensate during the high pressure portion of the respiratory cycle, or condensate could be aspirated back into the respiratory line during the low pressure portion of the respiratory cycle. Many of the devices did not operate continuously, and from time to time had to be emptied. Finally, many of the devices simply did not effectively and efficiently drain the respiratory line, making it difficult for the patient to breath.

SUMMARY OF THE INVENTION

The drain of the present invention is adapted for use with a respiratory line of the type that is alternately under high pressure during the patient's inspiration, and low pressure during the patient's expiration. Generally the drain comprises a hollow body having an inlet end adapted for connection to the respiratory line, the inlet end having an inlet opening therein, and an outlet end, the outlet end having an outlet opening therein. There is a one-way reed-type valve adjacent one end of the body. The reed-type (or duckbill) valve comprises two converging flexible members configured to allow condensate to pass in one direction. There is also a float valve inside the body. The float valve comprises a float member that normally seats over valve opening to close the opening, but which, when sufficient condensate is present in the body, can float to allow the condensate to pass through the opening.

In the first preferred embodiment, the reed-type valve is adjacent the inlet end and the float valve is downstream, adjacent the outlet end. In the second preferred embodiment, the reed-type valve and the float valve are both adjacent the outlet end, with the float valve upstream of the reed-type valve.

The drain is of simple and inexpensive construction, yet reliably functions to drain condensate from a respiratory line, while maintaining pressure for proper respiratory function. Referring to the first preferred embodiment, during the high pressure portion of the respiratory cycle, the reed-type valve readily admits condensate through the inlet opening, but the float valve closes the outlet opening to block the escape of pressure. During the low pressure portion of the respiratory cycle, the reed-type valve prevents the aspiration of condensate through the inlet opening into the respiratory line. Referring to the second preferred embodiment, during the high pressure portion of the respiratory cycle the float valve closes the outlet end and thus blocks the escape of pressure. During the low pressure portion of the respiratory cycle, the reed-type valve prevents aspiration of condensate back into the drain through the outlet, while allowing condensate to drain through the outlet when sufficient condensate is present to cause the float member to float and unblock the outlet. Thus the drains keep the line free from condensate, but prevent air from escaping from the respiratory line during the high pressure section of the respiratory cycle, and prevent condensate from refluxing into the respiratory line during the low pressure portion of the respiratory cycle.

These and other features and advantages will be in part apparent and in part pointed out hereinafter.

BRIEF DESCRIPTION OF THE DRAWINGS

FIG. 4 is a perspective view of a first alternate construction for the reed-type valve employed in the drain;

FIG. 5 is a vertical cross-sectional view of the valve shown in FIG. 4, taken along the plane of line 5—5 in FIG. 4;

FIG. 6 is a vertical cross-sectional view of the invention shown in FIG. 4 taken along the plane of line 6—6 in FIG. 5;

FIG. 7 is a bottom plan view of the valve shown in FIG. 4;

FIG. 8 is a perspective view of a second alternate construction for the reed-type valve employed in the drain;

FIG. 9 is a vertical cross-sectional view of the valve shown in FIG. 8, taken along the plane of line 9—9 in FIG. 8; and FIG. 10 is a bottom plan view of the valve shown in FIG. 8;

FIG. 11 is a top plan view of a second embodiment of a condensate drain constructed according to the principles of this invention, showing the inlet end, and also showing the grill of the cage;

FIG. 12 is a vertical cross-sectional view of the condensate drain of the second embodiment, taken along the plane of line 12—12 in FIG. 11;

FIG. 13 is a bottom plan view of the condensate drain of the second embodiment, showing the outlet end, and also showing the one-way reed valve.

FIG. 14 is a horizontal cross-sectional view taken along the plane of line 14—14 in FIG. 12;

FIG. 15 is a partial vertical cross-sectional view of the second embodiment taken along the plane of line 15—15 in FIG. 11.

Corresponding reference numerals indicate corresponding parts throughout the several views of the drawings.

DETAILED DESCRIPTION OF THE PREFERRED EMBODIMENTS

Figure 1:
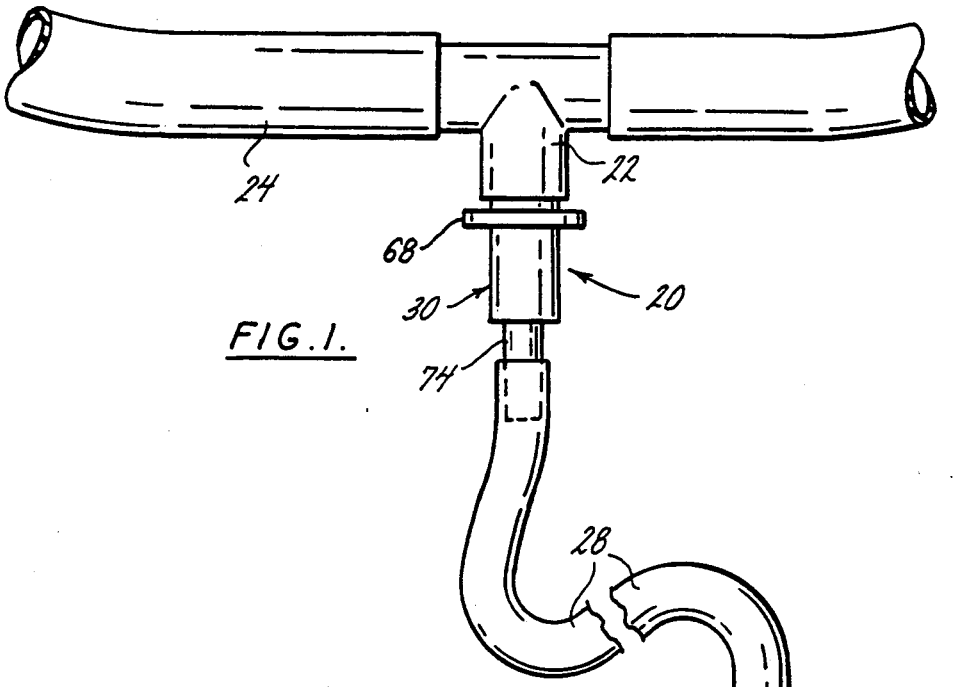
FIG. 1 is a side elevation view of a first embodiment of a condensate drain constructed according to the principles of this invention, shown as it would be attached to a respiratory air line.

A first embodiment of a condensate drain constructed according to the principles of this invention, indicated generally as 20, is shown in FIG. 1 as it would be connected to a specially constructed T-fitting 22 in a respiratory air line 24. The device 20 is particularly adapted for use with respiratory equipment that alternatively provides both high pressure in the respiration line to assist the patient's inhalation, and low pressure on the respiratory line to assist the patient's exhalation. A collection device, such as bag 26 is connected to the outlet end of the device 20 via a tube 28 to collect the condensate drained from the respiratory line 24.

Figure 2:
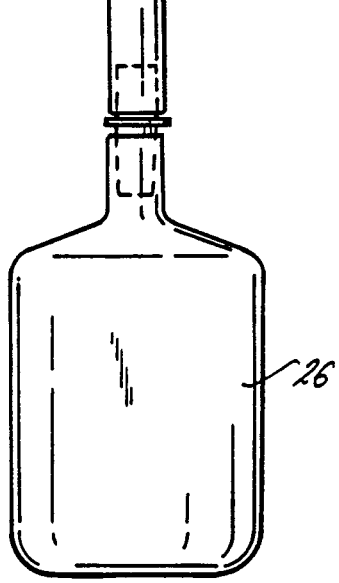
FIG. 2 is an enlarged vertical cross sectional view of the condensate drain of the first embodiment.
Figure 3:
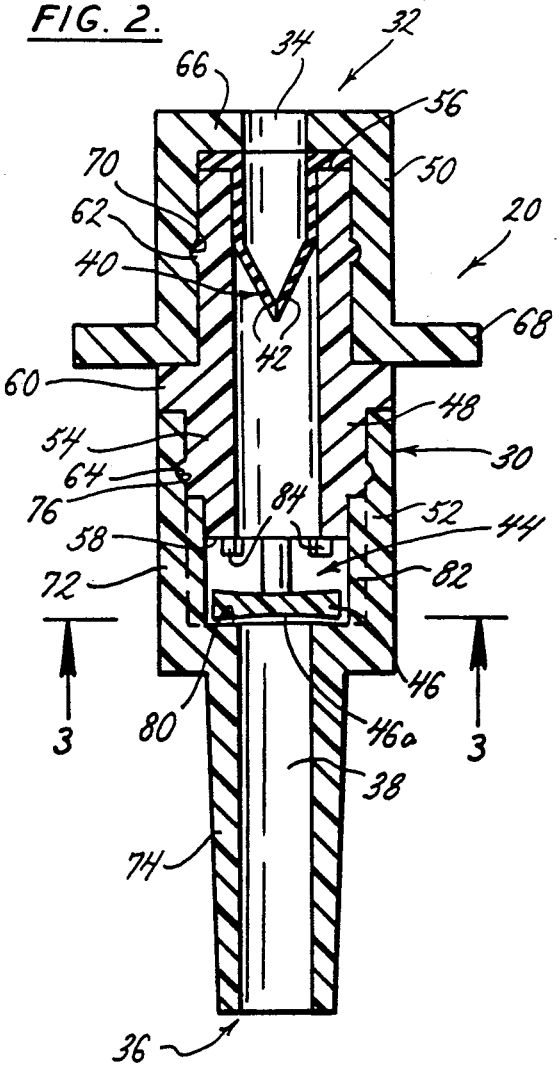
FIG. 3 is a horizontal cross-sectional view taken along the plane of line 3—3 in FIG. 2.
Figure 3:
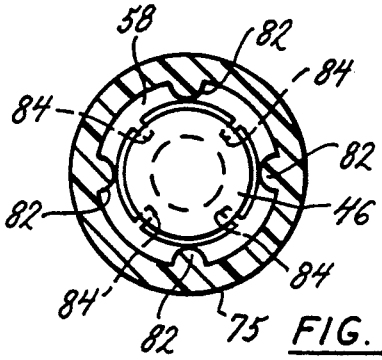

As best shown in FIG. 2, the condensate drain 20 comprises a body 30, having an inlet end 32 with an inlet opening 34 therein, and an outlet end 36 with an outlet opening 38 therein. The inlet end 30 is adapted to fit in a branch of T-fitting 22, incorporated as part of the respiratory air line 24. The outlet end 36 is adapted to connect to tube 28 which is in turn connected to collection bag 26.

The device 20 also includes a one-way reed-type valve 40 generally adjacent the inlet opening 34. The reed-type valve 40 is preferably made from a flexible, resilient rubber-like material, and comprises two converging flexible members 42 configured to allow condensate to enter the body 30 through the inlet opening 34 but to restrict condensate from exiting the body through the inlet opening.

The valve 40 can be formed by flattening the lower end of a tube. A suitable valve 40 is a duckbill valve, available from Vernay Laboratories, P.O. Box 310, Yellow Springs, Ohio, 45387.

A first alternate construction for the reed type valve is indicated generally as 40' in FIGS. 4–7. The valve 40' comprises two opposing generally planar members **40'*a*, and two side gussets 40'*b* As best shown in FIGS. 4 and 7, the intermediate portions of the planar members may be provided with raised lands 40'*c* to accommodate the thickness of the fold of the gussets 40'*b* so that the bottom of the valve 40' achieves a leak resistant seal. The valve 40' can be formed by forming inwardly folded gussets in the flattened lower end of a tube. A suitable valve 40'** is also available from Vernay Laboratories.

A second alternate construction of the reed-type valve is indicated generally as 40'' in FIG. 8–10. As best shown in FIGS. 8 and 10, the lower portion of the valve 40'' has a generally cruciform cross-section, comprising perpendicularly intersecting pairs of planar members **40''*a* and 40''*b* and 40''*c* and 40''*d* forming four branches or legs 40''*e*, 40''*f*, 40''*g*, and 40''*h*. The opposing planar members close tightly to achieve a leak resistant seal. The valve 40'' can be formed by making four equally spaced inward folds in the lower end of a tube. A suitable valve 40''** is also available from Vernay Laboratories.

The gusseted cross-section of the valve 40' and the cruciform cross-section of the valve 40'' allow the valves to quickly and easily open to allow condensate into the drain (as shown in phantom in FIGS. 5 and 9), yet retain the reed-type valve construction of opposing generally planar members which quickly responds to negative pressure, tightly sealing to prevent condensate from being drawn back into the respiratory line.

The device 20 also includes a float valve 44 generally adjacent the outlet end of the body 30. The float valve 44 comprises a float member 46 that normally seats over the outlet opening 38 to close the outlet opening, but which when sufficient condensate is present, floats to allow condensate to drain out the outlet opening. The float is preferably made from molded plastic having a specific gravity of less than one, for example polypropylene.

As shown in FIG. 2, the body 30 can comprises three pieces: central section 48, upper section 50, and lower section 52. All three pieces are preferably made from molded plastic, such as polyethylene. The central section 48 comprises a generally cylindrical tube 54, having an upper end 56 and a lower end 58, and an annular flange 60 projecting generally radially outwardly from the tube 54 intermediate its ends. There is a raised annular bead 62 on the exterior of the tube above the flange 60, and a raised annular bead 64 on the exterior of the tube below the flange 60.

The upper section 50 is generally top-hat shaped, comprising a downwardly facing cup-shaped portion 66 adapted to fit over the upper end 56 of central section 48. An annular flange 68 projects radially from the lower end of the cup-shaped portion 66. The inlet opening 34 extends through the cup-shaped portion 66. A portion of the lower face of flange 68 abuts the upper face of the flange 60 on the central section 48. The interior of the upper section 50 has an annular groove 70 therein adapted to receive the annular bead 62 on the central section 48 to hold the upper section 50 on the central section.

The lower section 52 comprises a hollow, generally cylindrical upper portion 72, and a hollow, generally cylindrical lower portion 74 having a smaller diameter than the upper portion. The upper portion is adapted to fit over the lower end 58 of the central section 48, and has an annular groove 76 therein to receive the annular bead 64 on the central section 48, to hold the lower section 52 on the central section. The upper end of the lower section 52 generally abuts the lower face of the flange 60. The lower portion 74 of the lower section 52 tapers to facilitate connection with a collection device, such as tube 28.

There is a shoulder 80 formed inside the upper portion of the lower section 52, between the upper and lower portions. The shoulder 80 surrounds the outlet opening 38. The shoulder 80 has a generally convex shape, forming a convex seat around the outlet opening 38. The valve member 46, which is preferably disk-shaped, has a mating concave configuration on its bottom surface **46*a*, so that it mates with the seat formed by the shoulder 80. The convex shape of the seat and the concave shape of the valve member 46 help to center the valve member over the outlet opening to properly close the outlet opening. The inside of the upper portion of the lower section has four semi-cylindrical projections 82 equally spaced about its circumference. The projections 82 also help center the valve member 46 over the outlet opening 38. Bosses 84 project downwardly from the lower end 58 of the central section 48 to limit the travel of the valve member 46**, to prevent it from becoming wedged in the open position.

A second embodiment of a condensate drain constructed according to the principles of this invention, indicated generally as 100, is shown in FIGS. 11–15. The condensate drain 100 comprises a body 102, having an inlet end 104 with an inlet opening 106 therein, and an outlet end 108 with an outlet opening 110 therein. The inlet end 104 is adapted to fit in a branch of T-fitting 22, incorporated as part of the respiratory air line 24. The outlet end 108 is adapted to connect to a tube 28, extending to a condensate collection bag 26.

Like drain 20 of the first preferred embodiment, the drain 100 comprises a one-way reed-type valve 114 and a float valve 116. However, in the second preferred embodiment the float valve 116 is positioned upstream from the reed-type valve 114. Both the float valve 116 and the reed-type valve 114 are positioned adjacent the outlet end 108.

The float valve 116 comprises a float member 118 that is trapped in a cage 120. The float member 118 is hollow, comprising an upper member 122 that telescopingly receives a lower member 124. The lower member 124 has a hemispherical valve surface 126 at lower end, forming the bottom of the float member 118. This valve surface 126 is adapted to engage a hemispherical valve seat 128 as described in more detail below. The upper and lower members 122 and 124 are preferably made from a plastic, such as polypropylene. An annular shoulder 130 surrounds the valve surface 126 on the bottom of the float member 118. There is an axially extending post 132 on the inside of the upper member 122 that engages an axially extending post 134 on the inside of the lower member 124. The ends of the posts 132 and 134 abut to limit the telescoping of the upper and lower members 122 and 124. The upper member 122 has a conical surface 136 at its upper end, forming the top of the float member 118.

As described above, the float member 118 is trapped within a cage 120. The cage 120 is formed inside the body 102. The inlet end 104 of the body is partially blocked by a grill 138, comprising five radially extending spokes 140. A spacing rod 142 extends axially inwardly from the center of the grill, to space the float member 118 from the grill 138. The interior of the cage has five equally spaced semi-cylindrical spacers 144 around its circumference. These spacers 144 help keep the float member 118 centered in the cage 120. These spacers 144 also define additional volume between them surrounding the float member 118 to allow condensate to surround the float member 118 and cause it to float.

The bottom of the cage 120 is closed by a disk 146, having the hemispherical valve seat 128 therein. There is an opening 148 centered in the valve seat 128 for the passage of condensate when the valve surface 126 is not sealed in the seat 128. The disk 140 is friction fit in the body 102, and maybe secured therein by adhesive, RF welding , or other suitable means. The spherical valve surface 126 on the lower end of float 118 seats in the spherical valve seat 128. The valve surface 126 and the seat 128 can have other configurations so long as they can sealingly mate to close the opening 148. It may be desirable to make one or both of these surfaces from a natural or artificial rubber to improve sealing.

The reed-type valve 114 is located adjacent the outlet end 108 of the body 102. The reed-type valve 114 preferably comprises two converging flexible members 150 similar to those in reed-type valve 40, described above with respect to the first embodiment. The reed-type valve may also be in the form of one of the valves 40' or 40'' shown in FIGS. 5–10, and described above. The reed-type valve 114 is disposed in a housing 152.

The housing 152 comprises a mounting ring 154, that is received in the outlet end of the body 102. The ring 154 has an inwardly extending flange 156. The base of the reed-type valve 114 abuts the lower surface of this flange 156. A tapering, stepped enclosure 158 fits inside the ring 154, sandwiching the base of the valve 114 against the flange 156 of ring 154. Two opposed stepped side portions 160 of the enclosure 158 accommodate the converging members 150 of the valve 114. The housing 158 converges to a spout 162 for connection to tube 28.

Figure 16:
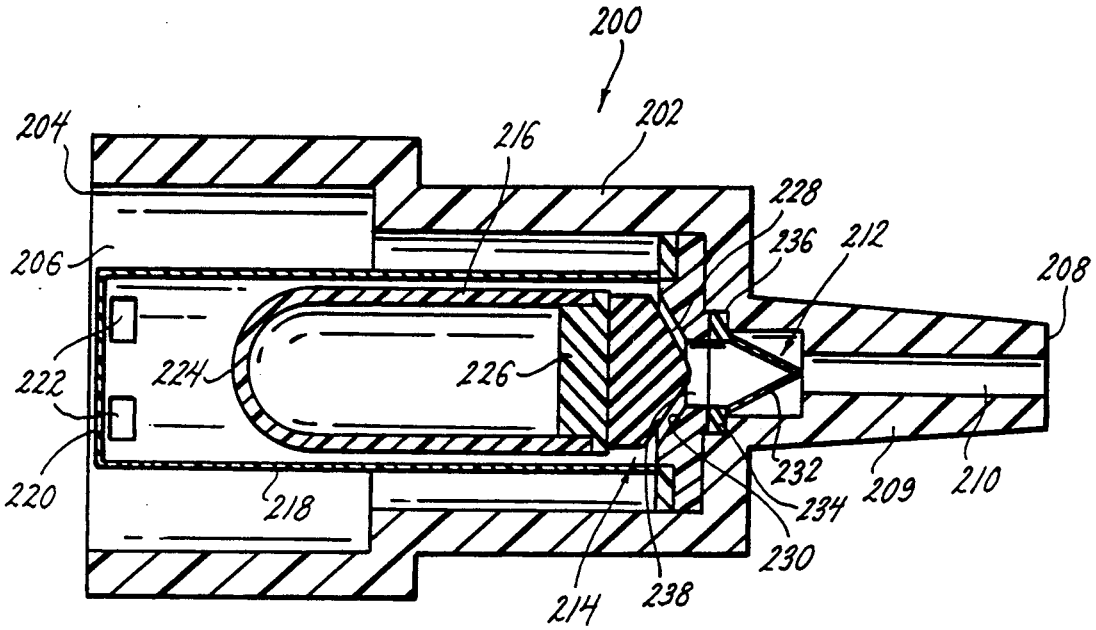
FIG. 16 is a longitudinal cross-sectional of a third embodiment of a condensate drain constructed according to the principles of this invention, with a sleeve for facilitating the action of the float member.

A third embodiment of a condensate constructed according to the principles of this invention, indicated generally as 200, is shown in longitudinal cross section in FIG. 16. The condensate drain 200 can be adapted to fit in a specially constructed T-fitting 22 in a respiratory air line 24, or otherwise connected to a respiratory air line to allow condensate to drain out. The device 200, like devices 20 and 100, is particularly adapted for use with respiratory equipment that alternatively provides both high pressure in the respiration line to assist the patient's inhalation, and low pressure on the respiratory line to assist the patient's exhalation. A collection device, such as bag 26 is connected to the outlet end of the device 200 via a tube 28 to collect the condensate drained from the respiratory line 24.

The condensate drain 200 comprises a body 202, having an inlet end 204 with an inlet opening 206 therein, and an outlet end 208 with an outlet opening 210 therein. The inlet end 204 is adapted to be connected to the respiratory air line 24. The outlet end 208 has a generally tapering spout 209 that is adapted to connect to tube 28 which is in turn connected to collection bag 26.

The condensate drain 200 comprises a one-way reed-type valve 212 and a float valve 214. However, in the third preferred embodiment, like the second preferred embodiment, the float valve 214 is positioned upstream from the reed-type valve 212. Both the float valve 214 and the reed-type valve 212 are positioned generally adjacent the outlet end 108.

The float valve 214 comprises a float member 216 that can reciprocate in a sleeve 218. The cross section of the sleeve 218 is slightly larger than the cross section of the float member so that the float member can slide freely therein. It is believed that the sleeve reduces drag on the float member 216 so that the float valve 214 operates more quickly with the sleeve 218 than without the sleeve. The sleeve 218 has a closed top 220 to trap the float member 216 therein. The sleeve 218 helps to center the float member 216 and guide its movement. The sleeve has openings 222 adjacent the upper and lower ends of the sleeve (only the openings adjacent the upper end of the sleeve are visible in FIG. 16) to allow condensate to enter the sleeve 218.

The float member 216 is hollow, comprising a generally capsule-shaped upper member 224 that fits on a lower member 226. The lower member 226 has a conical valve surface 228 forming the bottom of the float member 216. This valve surface 228 is adapted to engage a conical valve seat 230, as described in more detail below. The upper and lower members 224 and 226 are preferably made from a plastic, such as polypropylene, while the valve surface 228 is preferably made of an elastomeric material, such as natural or artificial rubber, to seal with the valve seat 230.

The reed-type valve 212 is located adjacent the outlet end 208 of the body 202. The reed-type valve 212 preferably comprises two converging flexible members 232 similar to those in reed-type valve 40 or 114, described above with respect to the first and second embodiments. The reed-type valve may also be in the form of one of the valves 40' or 40" shown in FIGS. 5–10, and described above. The reed-type valve 212 is has an annular rim 234 that is seated in an annular grove 236 in the body 202, and held in place by the valve seat 230. The valve seat 230 is generally annular with a centeral passage 238 for the passage of condensate therethrough. Like the valve surface 228, the valve seat can be made of an elastomeric material, such as a natural or artificial rubber.

The float member 216 of the float valve 214 can float in the presence of condensate inside the body 202, thereby allowing condensate to pass out through the reed-type valve 212. However where there is high pressure in the respiration line, the condensate is force out of the body, and the float member 216 seats in the valve seat, blocking the escape of pressure through the drain 200. When there is low pressure in the respiration line, the reed-type valve 212 blocks the reflux of condensate, or the aspiration of air through the drain 200.

OPERATION

In operation, the device 20 of the first embodiment of this invention is installed in a T-fitting 22 in a respiratory air line 24. The flange 68 facilitates the insertion and removal of the device 20 from the fitting 22. The lower end of the device is connected to a condensate collection bag 26 via a tube 28 that fits over the lower portion 74 of the lower section 52. Condensate in the respiratory line 24 passes through the inlet opening 34 in the device 20, through the reed-valve 40, and into the body 30. However, the flexible members 42 forming the reed valve 40, prevent condensate from flowing back out the inlet opening 34 into the respiratory line 24. When the level of condensate inside the chamber in the body 30 approaches the height of the top of the valve member 46, the valve member 46 will float, allowing the condensate to drain out the outlet opening 38 of the body. The projections 82 help center the float member 46 while allowing sufficient condensate to surround the float member to raise the float member to drain the body. The device 20 is preferably oriented vertically, and the distance between the reed valve 40 and the float valve 44, together with the reed valve 40, helps to prevent condensate from being drawn back into the respiratory line 24.

In operation, the device 100 of the second embodiment of this invention is installed in a T-fitting 22 in a respiratory airline 24. The outlet end 108 of the device 100 is connected to a condensate collection bag 26 via tube 28, which fits over the end of spout 162. Condensate in the respiratory line 24 enters the inlet opening 106 at the inlet end 104 of the device, passing through the grill 138 and into the cage 120. The condensate fills the cage 120, surrounding the float member 118 until it floats. When the float member 118 begins to float, the valve surface 126 is unseated from valve seat 128, permitting the condensate to drain through opening 148. The float member 118 closes the opening 148 after the condensate has drained, preventing air from escaping (and thus preventing pressure loss) through the device 100 during the high pressure portion of the respiratory cycle. The reed-type valve 114 readily passes the condensate out of the device through the spout 162 to tube 28 and collection bag 26. However, during the low pressure portion of the cycle, the reed-type valve 114 prevents condensate from refluxing back into the body 102 during the low pressure portion of the respiratory cycle. The conical shape of the top of the float member 118 and the spacing rod 142 prevent the float member 118 from occluding the grill 138.

In operation, the device 200 of the third embodiment of this invention is installed in a T-fitting 22 in a respiratory airline 24. The outlet end 206 of the device 200 is connected to a condensate collection bag 26 via tube 28, which fits over the end of the spout 209. Condensate in the respiratory line 24 enters the inlet opening 206 at the inlet end 204 of the device, passing through the openings 222 in the sleeve 218. The condensate fills the cage sleeve 218, surrounding the float member 216 until it floats. When the float member 216 begins to float, the valve surface 228 is unseated from valve seat 230, permitting the condensate to drain through opening 236. The float member 216 closes the opening 236 after the condensate has drained, preventing air from escaping (and thus preventing pressure loss) through the device 200 during the high pressure portion of the respiratory cycle. It is believed that the sleeve 218 facilitates the movement of the float member both in opening and closing the float valve. The reed-type valve 212 readily passes the condensate out of the device through the spout 209 to tube 28 and collection bag 26. However, during the low pressure portion of the cycle, the reed-type valve 212 prevents condensate from refluxing back into the body 202 during the low pressure portion of the respiratory cycle.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. A drain for removing condensate from a respiratory air line that is alternately under relatively high pressure during the patient's inspiration, and under relatively low pressure during the patient's expiration, the drain comprising:

a hollow body having an inlet end, adapted for connection to the respiratory air line, and having an inlet opening therein, and an outlet end having an outlet opening therein;

a one-way reed-type valve for permitting condensate to pass through the body from the inlet to the outlet, but restricting condensate from refluxing back into the respiratory line during periods of relatively low pressure in the respiratory line, the reed-type valve comprising two converging flexible members configured to allow condensate to flow in one direction through the body;

a float valve that is normally closed to restrict the flow of air through the body during periods of relatively high pressure in the respiratory line, but which opens in the presence of condensate to allow condensate to flow out of the body, the float valve comprising a float member that normally seats over a valve opening to close the outlet opening, but which when sufficient condensate is present in the body floats to allow the condensate to pass through the body.

2. The drain according to claim 1 wherein the reed-type valve is adjacent the inlet end of the body, and wherein the float valve is adjacent the outlet end of the body.

3. The drain according to claim 1 wherein the reed-type valve is adjacent the outlet end, and wherein the float type valve is upstream of the reed-type valve.

4. The drain according to claim 1 wherein the reed-type valve has a gusseted cross-section.

5. The drain according to claim 4 wherein the reed-type valve comprises opposing generally flat members joined at the sides with inwardly folded gussets.

6. The drain according to claim 5 wherein the flat members have raised lands between the gussets, to accommodate the thickness of the gussets.

7. The drain according to claim 1 wherein the reed-type valve has a generally cruciform cross section.

8. The drain according to claim 1 wherein the reed-type valve comprises perpendicularly intersecting pairs of planar members.

9. The drain according to claim 1 wherein the float member is generally elongate, and further comprising a sleeve surrounding the float member, the sleeve closely conforming to the float member, but sufficiently large to allow the float member to freely reciprocate therein.

10. A drain for removing condensate from a respiratory air line that is alternately under relatively high pressure during the patient's inspiration and under relatively low pressure during the patient's expiration, the drain comprising:

a hollow body having an inlet end, adapted for connection to the respiratory air line, and having an inlet opening therein, and an outlet end having an outlet opening therein;

a one-way reed-type valve adjacent the inlet end of the body, the reed valve comprising two converging flexible members configured to allow condensate to enter the body through the inlet opening but restrict flow out of the body;

a float valve adjacent the outlet end of the body, the float valve comprising a float member that normally seats over the outlet opening to close the outlet opening, but which when sufficient condensate is present in the body floats to allow the condensate to drain out the outlet.

11. The drain according to claim 10 wherein there is a generally convex seat surrounding the outlet opening, and wherein the float is has a generally concave surface to mate with the generally convex seat.

12. A drain for removing condensate from a respiratory air line that is alternately under relatively high pressure during the patient's inspiration and under relatively low pressure during the patient's expiration, the drain comprising:

a hollow body having an inlet end, adapted for connection to the respiratory air line, and having an inlet opening therein, and an outlet end having an outlet opening therein;

a float valve, adjacent the outlet end of the body, the float valve comprising a cage and a float member contained within the cage, the cage having an outlet end having an outlet opening, the float member normally seats over the cage outlet opening to close the opening, but which when sufficient condensate is present in the cage floats to allow the condensate to drain out the cage outlet; and a one-way reed valve adjacent the outlet end of the body, the reed valve comprising two converging flexible members configured to allow the condensate to drain from the cage outlet out of the body outlet but restricts flow of condensate into the body outlet.

13. The drain according to claim 12 wherein there is a generally concave seat surrounding the cage outlet opening, and wherein the float has a generally convex surface to mate with the generally concave seat.

14. The drain according to claim 12 wherein the cage comprises a grill adjacent the body inlet opening.

15. The drain according to claim 12 wherein the reed valve has a gusseted cross-section.

16. The drain according to claim 12 wherein the reed valve comprises opposing generally flat members joined at the sides with inwardly folded gussets.

17. A drain for removing condensate from a respiratory air line that is alternately under relatively high pressure during the patient's inspiration and under relatively low pressure during the patient's expiration, the drain comprising:

a hollow body having an inlet end, adapted for connection to the respiratory air line, and having an inlet opening therein, and an outlet end having an outlet opening therein;

a float valve, adjacent the outlet end of the body, the float valve comprising a chamber in the body having an outlet opening and a float member in the chamber which normally seats over the cage outlet opening to close the opening, but which when sufficient condensate is present in the chamber floats to allow the condensate to drain out chamber opening; and a one-way reed valve adjacent the outlet end of the body, the reed valve comprising two converging flexible members configured to allow the condensate to drain from the cage outlet out of the body outlet but restricts flow of condensate into the body outlet.

18. The condensate drain according to claim 17 wherein the float member is generally elongate, and further comprising a sleeve in the chamber, surrounding the float member, the sleeve closely conforming to the float member, but sufficiently large to allow the float member to freely reciprocate therein.

* * * * *